US007144284B1

(12) United States Patent
Horan et al.

(10) Patent No.: US 7,144,284 B1
(45) Date of Patent: Dec. 5, 2006

(54) ROWING OAR SYSTEM

(76) Inventors: Richard Horan, 226 Beach 101st St., Rockaway Park, NY (US) 11694; Kerry Guarino, 706 Marlborough Common, Hillsboro, NJ (US) 08844

( * ) Notice: Subject to any disclaimer, the term of this patent is extended or adjusted under 35 U.S.C. 154(b) by 99 days.

(21) Appl. No.: 11/231,572

(22) Filed: Sep. 21, 2005

(51) Int. Cl.
*B63H 16/04* (2006.01)

(52) U.S. Cl. ..... 440/102

(58) Field of Classification Search ..... 440/101–109; 416/74

See application file for complete search history.

(56) References Cited

U.S. PATENT DOCUMENTS 325,055 A * 8/1885 Clark ..... 440/102
402,114 A * 4/1889 Sweet ..... 440/102
3,324,490 A * 6/1967 Jewett ..... 440/101
2005/0070181 A1* 3/2005 Bleicken ..... 440/104

FOREIGN PATENT DOCUMENTS

JP 5-345592 * 12/1993

* cited by examiner

*Primary Examiner*—Ed Swinehart
(74) *Attorney, Agent, or Firm*—Michael J. Tavella

(57) ABSTRACT

An oar consisting of two parallel shafts linked on both ends to form a parallelogram configuration, which keeps the oar's blade and handle parallel to one another and perpendicular to the boat throughout the rowing cycle. The system is further enhanced to provide an internal, adjustable feathering system, interchangeable handles and blades and an integrated, quick-release oarlock.

18 Claims, 21 Drawing Sheets

ROWING OAR SYSTEM

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

The present invention relates to a rowing apparatus having an oar and oarlock and particularly to a rowing apparatus having improved efficiency.

2. Description of the Prior Art

Conventional rowing systems use oars with handles and blades that are solidly fixed to and inline with the oar shaft. An oarlock is positioned about a third of the way down the shaft between the handle and blade. The oarlock acts as a fulcrum about which the oar pivots. As the handle is pulled by the rower, the blade on the opposite end of the oar is pulled through the water in an arc, thereby propelling the boat.

As the rower moves the oar through the power stroke, the oar handle and blade are perpendicular to the rower and the boat for a brief instant. Because the most efficient transfer of energy is when the oar pushes against the water perpendicularly with respect to the boat, to improve efficiency and reduce physical stress on the rower it would be advantageous if the angle of the handle and blade always remained perpendicular, regardless of where the oar was in the stroke.

Moreover, when resetting the blade at the end of the stroke, the oar is removed from the water and moved backwards to begin the next stroke. During this backward motion, the oar blade is usually "feathered" (turned 90 degrees so that it is parallel to the surface of the water) to reduce wind resistance and to minimize friction should the blade come in contact with the water on the return stroke.

Previous inventions that have described the use of universal joints and/or gears to provide feathering systems: Johnson U.S. Pat. No. 1,034,462, Jaeger U.S. Pat. No. 1,909,359, Noogle U.S. Pat. No. 4,738,643, and DuPont U.S. Pat. No. 5,248,272.

While these patents describe feathering systems, they do nothing to solve the problem of maximizing efficiency in the oar stroke itself.

BRIEF DESCRIPTION OF THE INVENTION

The instant invention solves this problem by creating an apparatus that keeps the oar handle and blade perpendicular to the boat at every point in the stroke.

The relationship between the orientation of the blade in the water and the boat's direction of travel is critical to achieving a powerful, efficient stroke. Keeping the blade square to the water as it is pulled through the water reduces power loss due to water sliding off of an angled blade, as is the case in a conventional set-up.

Moreover, a new internal feathering system is incorporated into the present invention to enable the rower to "feather" the blade flat above the water on the return stroke to reduce air friction.

The benefits of this design are found in the "parallelogram" design, which requires two oar shafts rather than the traditional one in conventional rowing systems. Composite H-Beams (essentially I-Beams turned on their side) are used to reduce weight and increase strength while reducing lateral bending.

Finally, the present invention incorporates a system for easily changing the oar's handles and blades. As mentioned above, maintaining the perpendicular orientation of the handle and blades is accomplished by a parallelogram-like structure with moveable attachment points. The ends of two (long) parallel shafts of equal length are joined at either end by (short) connecting rods that make up a parallelogram. The oar's handle and blade are attached perpendicularly to the short connecting rods on either end of the long oar shafts.

This geometric structure is connected to two stationary pivot points that perform some of the basic functionality of a traditional oarlock. The entire apparatus (integrated oar and oarlock) is mounted on a standard outrigger (as found in most sculls and racing shells) or a custom structure on any boat that can be propelled by oars.

When in use, the rower begins his/her power stroke by extending his arms and grasping the handle (sweep oar) or handles (scull) which are perpendicular to the boat. Raising the handles lowers the blades into the water. The rower now pulls on the handles, which cause the blades to be pulled through the water. Both handles and the blades remain perpendicular to the boat and parallel to each other throughout the power stroke.

At the end of the power stroke, the rower pushes the handle(s) down thereby raising the blade out of the water. Simultaneously the rower rotates his hands backwards 90 degrees to feather the blade for the return stroke. Again, both handles and the blades remain perpendicular to the boat and parallel to each other throughout the return stroke.

Oarlocks serve two primary purposes: to allow the oar to rotate fore and aft about a pivot point and to allow the oar shaft to pivot up and down, which allows the oar blade to be lowered into and raised out of the water. The pivot points in the present invention are located in the traditional location, approximately ⅓ of the way down the shafts when measured from the handle. The dual shaft design of the parallelogram requires two pivot points as opposed to the single pivot point in a traditional oar and oarlock design. Further, the oarlock in the current invention is integrated into the oar shafts as opposed to being a separate component mounted on the boat gunwales or outrigger.

There is also a swivel bearing present in the middle of the oarlock, between the two main oar shafts to provide support for the feathering rod.

The conventional rowing system has fixed handles and blades. This invention incorporates the ability to quickly change handles and blades. This capability is a real advantage when wanting to use different blades and/or handles for different purposes (racing or recreation) or conditions (smooth water or choppy). It also allows rowers to replace damaged components more easily than with the now used one-piece design.

The handle and oar share common attachment hardware. They are both physically attached to the internal feathering system that resides within the parallelogram shaft structure.

Finally, as mentioned above, the system allows the rower to keep the oar handle perpendicular to the rower.

It is an object of the present invention to provide an oar design, both sweep and scull) of improved efficiency by keeping the handle and blade perpendicular to the rower and direction of travel of the boat at all times.

It is a further object of the present invention to provide a method for adjusting the oar's leverage by changing the position of the oar relative to the oarlock.

It is a further object of the present invention to provide an integrated oarlock that can be easily attached to and removed from standard gunwales or outriggers and permits free movement of the oar assembly in two axes.

It is yet a further object of the present invention to provide a means for feathering the blade (twisting the oar handle 90 degrees on the return stroke to cut down on air/water resistance of the blade).

It is another object of the present invention to provide an adjustment for the "attack" angle of the blade on the power stroke and the "feathering" angle of the blade on the return stroke.

The present invention also improves the state of the art by incorporating a system for easily changing the oar's handles and blades. Traditional oars make no provisions for interchanging handles and blades of different sizes and shapes. To change the handle and/or blade, the oar itself usually must be changed. It is further the object of the present invention to provide a method for increasing the stiffness and reducing the weight of the oar shafts.

BRIEF DESCRIPTION OF THE DRAWINGS

FIG. 6*a* is a side view of the vertical oar movement about the oarlock with the blade horizontal.

DETAILED DESCRIPTION OF THE INVENTION

Figure 1A:
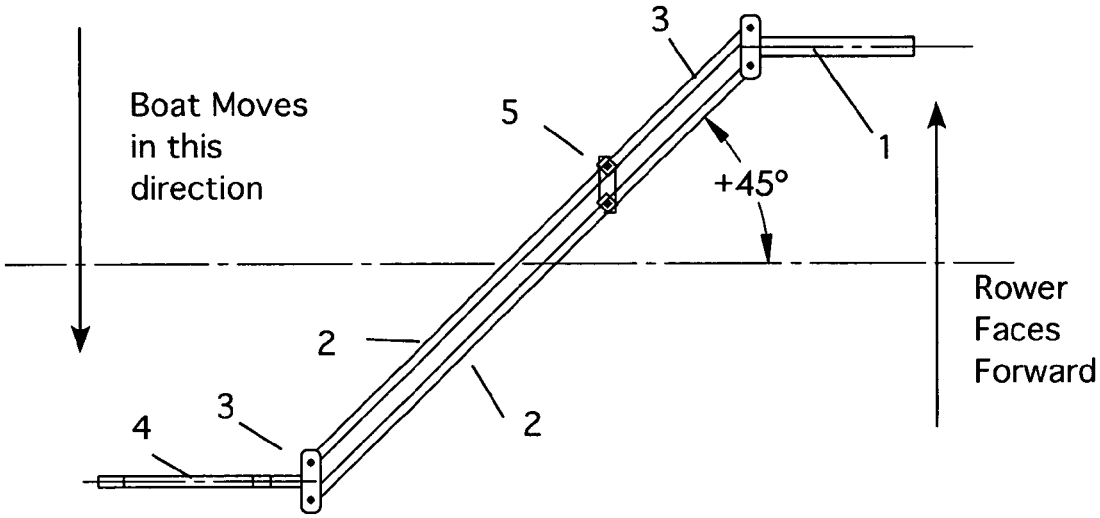
FIG. 1*a* is a top schematic view of the new design at the beginning of the power stroke.
Figure 1B:
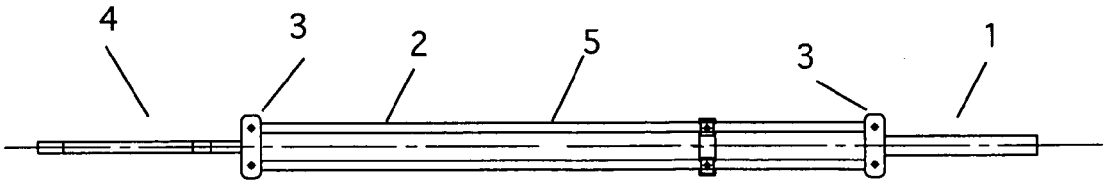
FIG. 1*b* is a top schematic view of the new design at the middle of the power stroke.
Figure 1C:
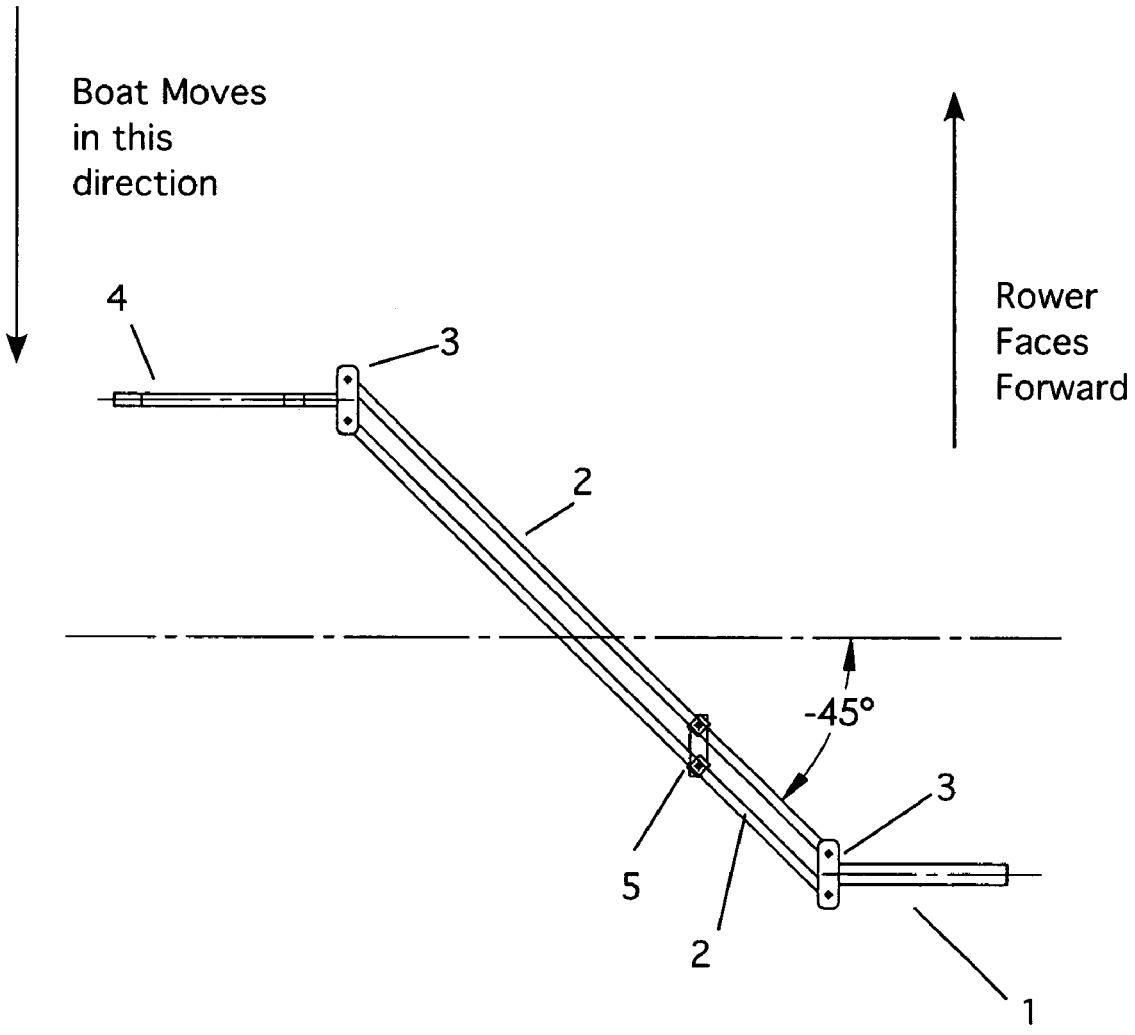
FIG. 1*c* is a top schematic view of the new design at the end of the power stroke.

Referring now to FIGS. 1*a*, 1*b*. 1*c*, 2 and 3, the new oar system is shown. The oar system is made up of a handle 1, a pair of oar shafts 2, of equal length; two end connectors 3 and a blade 4. Note that the oar shafts are pivotably attached to the end connectors so that as the handle is moved, the oar shafts move about to create a parallelogram configuration, as shown in FIGS. 1*a*, 1*b* and 1*c*. An oarlock 5 is shown at a central point. The oarlock 5 allows the oar shafts to rotate as shown. The oarlock also allows the oar to move vertically, as discussed below. The oarlock 5 is shown in its preferred position, which is about ⅓ of the way down the shaft from the handle. However, the oarlock 5 can be positioned at other places along the shaft (if desired). See, e.g., FIGS. 4 and 5.

In FIG. 1*a*, the direction of the rower and the direction of the travel of the boat are indicated by the arrows. The rower pulls rearward on the handle 2 (as indicated by the arrow). At the beginning of the stroke, the handle is fully forward, the oar shafts are at a 45-degree angle with respect to the centerline of the rower and the blade is fully back and positioned perpendicularly to the boat.

When in use, the rower begins his/her power stroke by extending his arms and grasping the handle (sweep oar) or handles (scull) which are perpendicular to the boat. Raising the handles (see, FIG. 6*c*) lowers the blades into the water. The rower now pulls on the handles, which cause the blades to be pulled through the water. Both handles and the blades remain perpendicular to the boat and parallel to each other throughout the power stroke. FIG. 1*b* shows the oar system in the middle of the stroke. Here, the handle, shafts and blade are aligned in a straight line.

FIG. 1*c* shows the end of the power stroke. Here, the handle is fully back, the blade is fully forward (and perpendicular to the boat) and the oar shafts are at a 45-degree angle with respect to the centerline of the rower (albeit at the opposite angle with respect to FIG. 1*a*). At the end of the power stroke, the rower pushes the handle(s) down thereby raising the blade out of the water. Simultaneously the rower rotates his hands backwards 90 degrees to feather the blade for the return stroke. (The feathering system is discussed below). Again, both handles and the blades remain perpendicular to the boat and parallel to each other throughout the return stroke.

Figure 2:
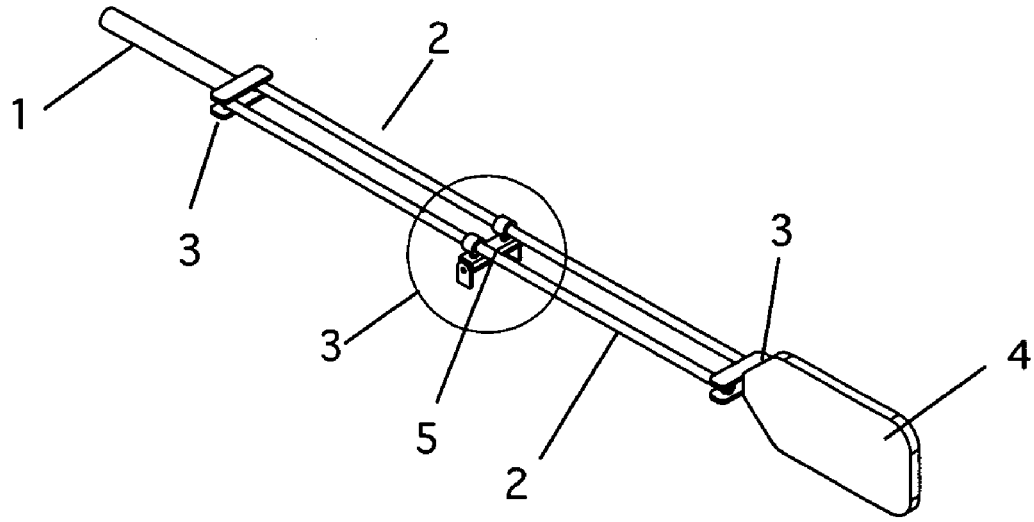
FIG. 2 is a perspective view of the new oar.
Figure 3:
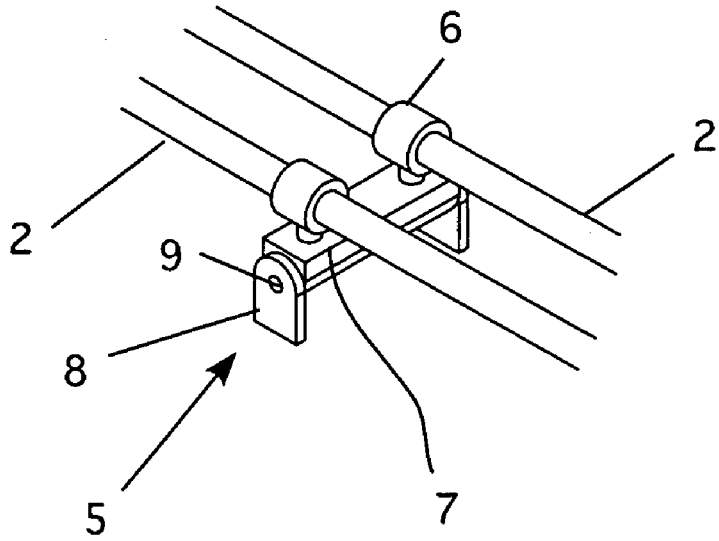
FIG. 3 is a detail of the oarlock system.

FIGS. 2–3 details of the oarlock used with cylindrical oar shafts.

FIG. 2 is a perspective view of the new oar showing the position of the oarlock 5 with respect to the oar shafts. Note that the oarlock system can use the clamps 6 (for a round oar shaft) shown in FIGS. 2–5, or a pin system (for the preferred H-beam shaft), shown in FIGS. 9–12 (discussed below). Note also that clamps can be used with the H-beam as well, although they are not preferred.

FIG. 3 is a detail of the oarlock system that uses round shafts for the oars. Here, clamps 6 secure the oar shafts 2 to the pivot body 7. The clamps are rotatably attached to the pivot body 7 so that the oar shafts are free to turn about the pivot body (see, e.g., FIGS. 1*a* and 5). The pivot body is secured to a bracket 8 by pins 9, that permit the pivot body to rotate about the bracket (see. e.g. FIGS. 3 and 6*a*–6*c*).

Figure 4:
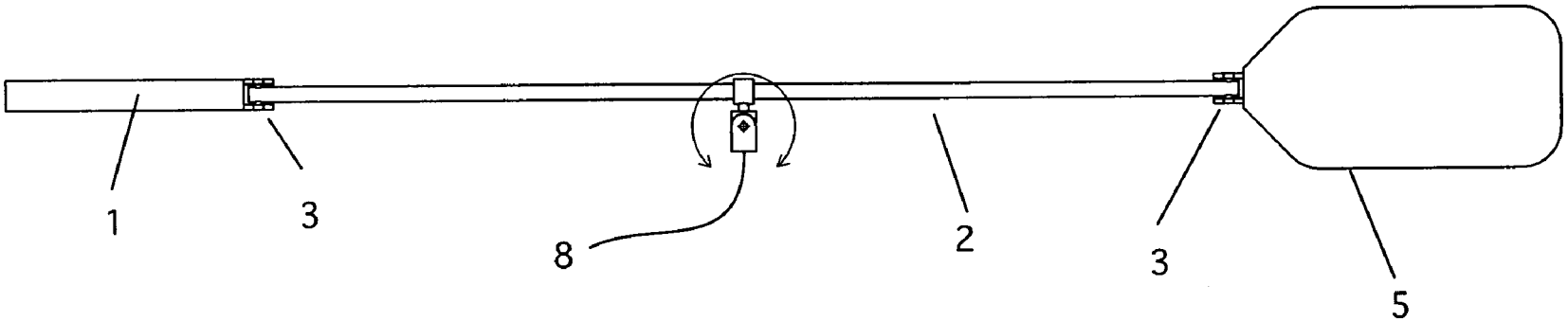
FIG. 4 is a side view of the oar system.

FIG. 4 is a side view of the oar system that shows the vertical movement of the oar shafts 2 with respect to the bracket 8. This movement is caused by the pivot body pivoting on the pins 9. Note also that the shafts can be positioned left or right of the position shown. This movement affects the leverage of the rower. Moving the shaft left, increases the leverage but decreases the stroke and vice versa.

Figure 5:
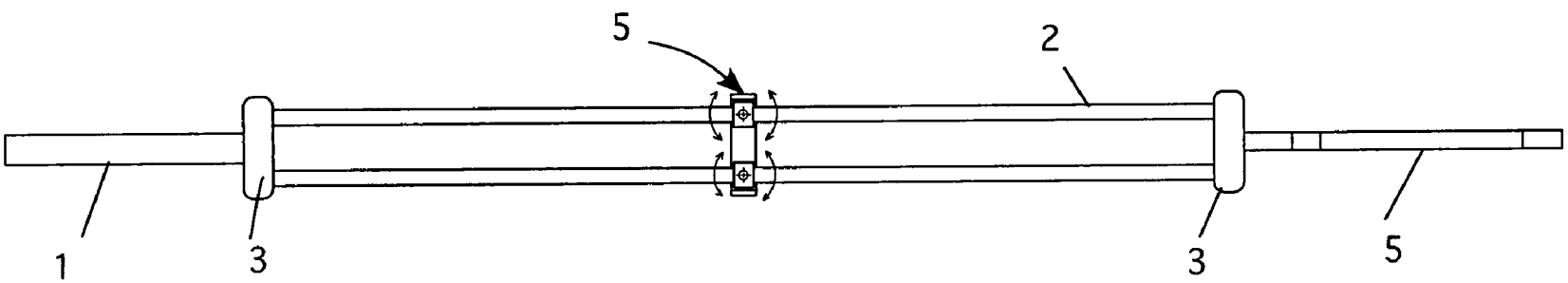
FIG. 5 is a top view of the oar system.

FIG. 5 is a top view of the oar system that shows the angular movement of the oar shafts 2 about the oarlocks.

Figure 6A:
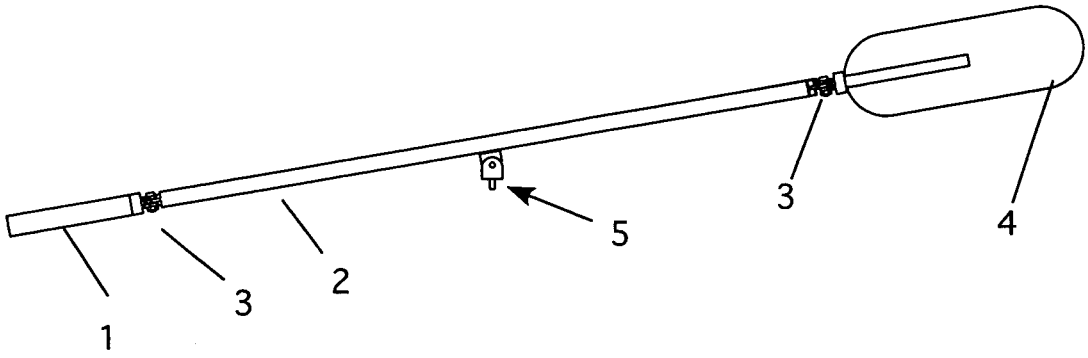
FIG. 6*a* is a side view of the vertical oar movement about the oarlock with the blade raised.
Figure 6B:
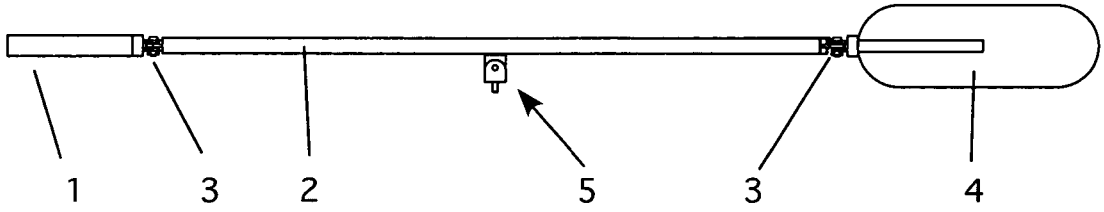
FIG. 6*c* is a side view of the vertical oar movement about the oarlock with the blade lowered.
Figure 6C:
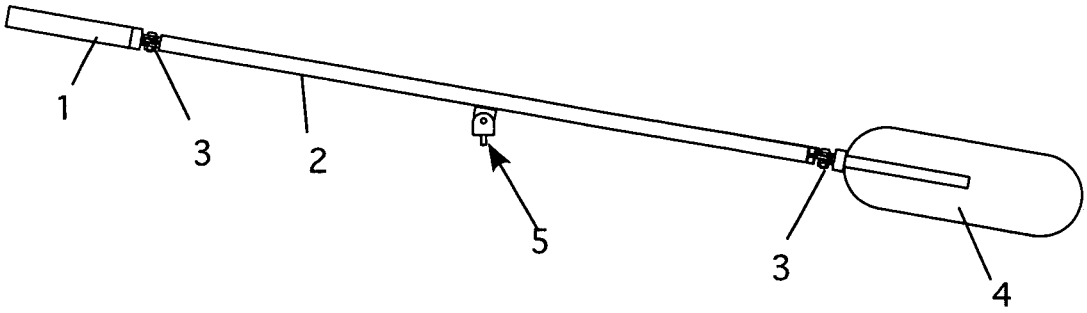

FIGS. 6*a*–6*c* are schematic views of the vertical oar movement about the oarlock. In FIG. 6*a*, the blade 4 is angled upward. This is accomplished by pivoting the pivot block. FIG. 6*b* shows the oar in the neutral position and FIG. 6*c* shows the blade of the oar in the downward position.

Figure 7A:
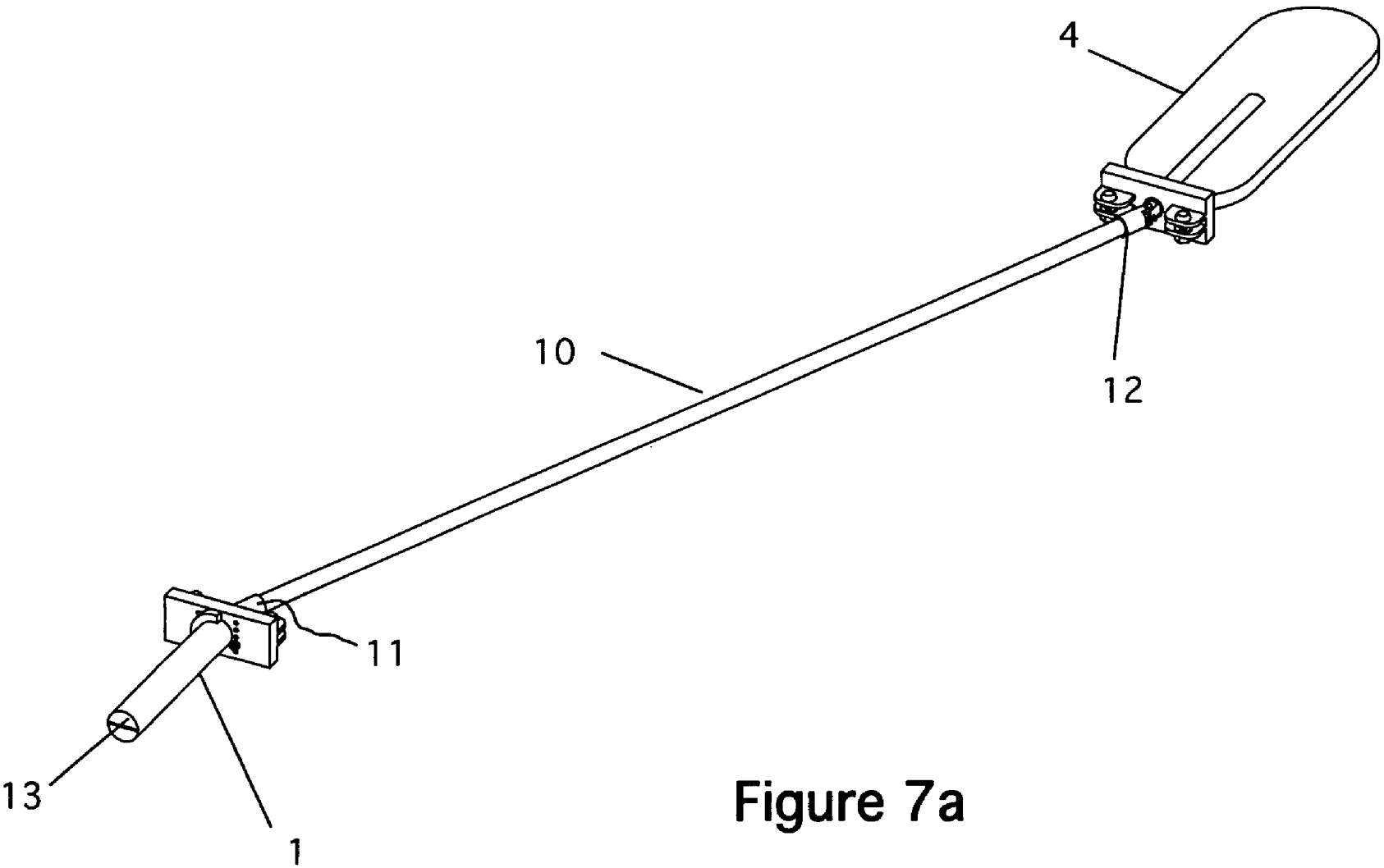
FIG. 7*a* is a perspective view of the feathering system with the oar shafts not shown and the blade in the fully feathered position.
Figure 7B:
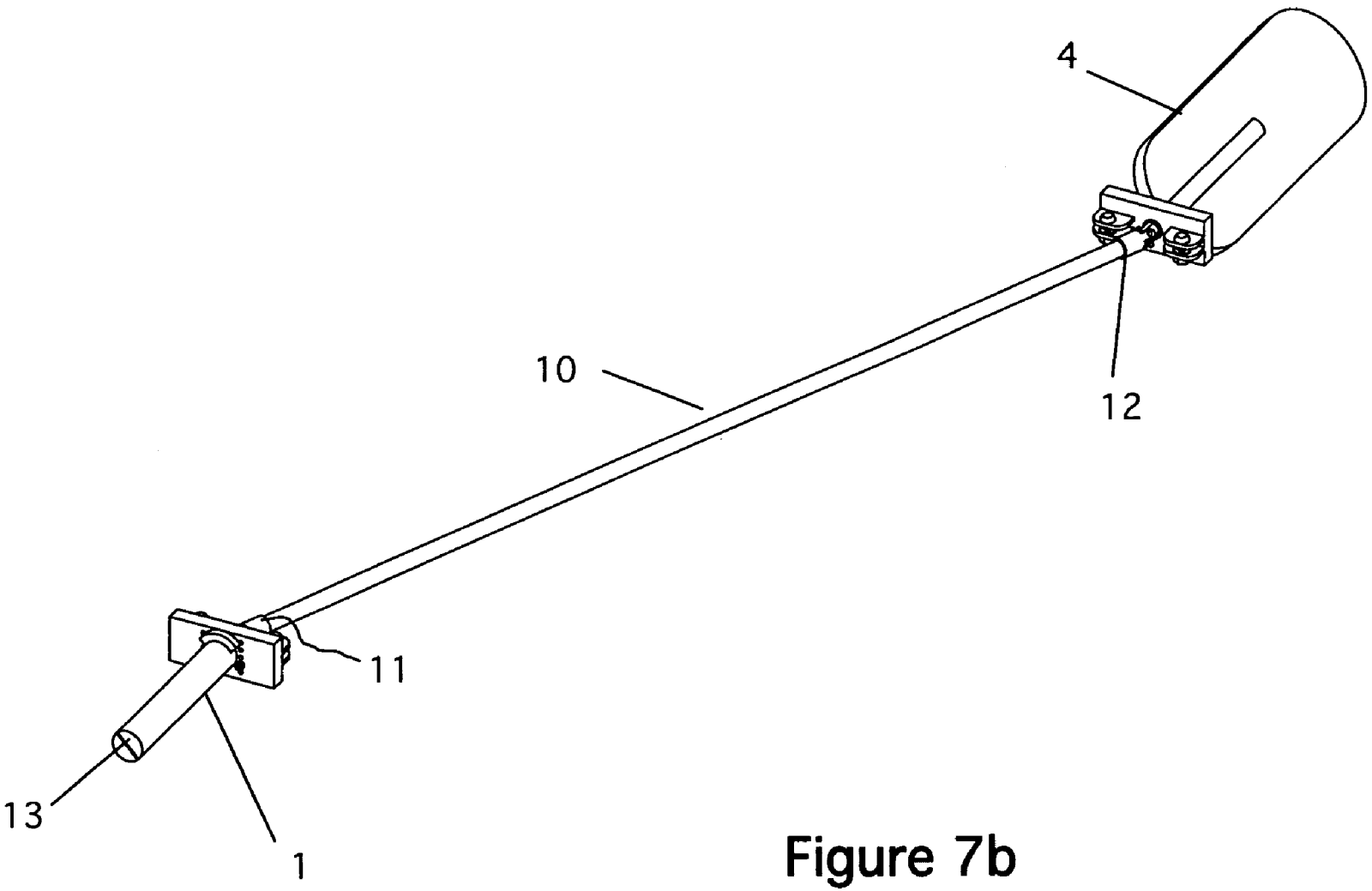
FIG. 7*b* is a perspective view of the feathering system with the oar shafts not shown and the blade in the partially feathered position.
Figure 7C:
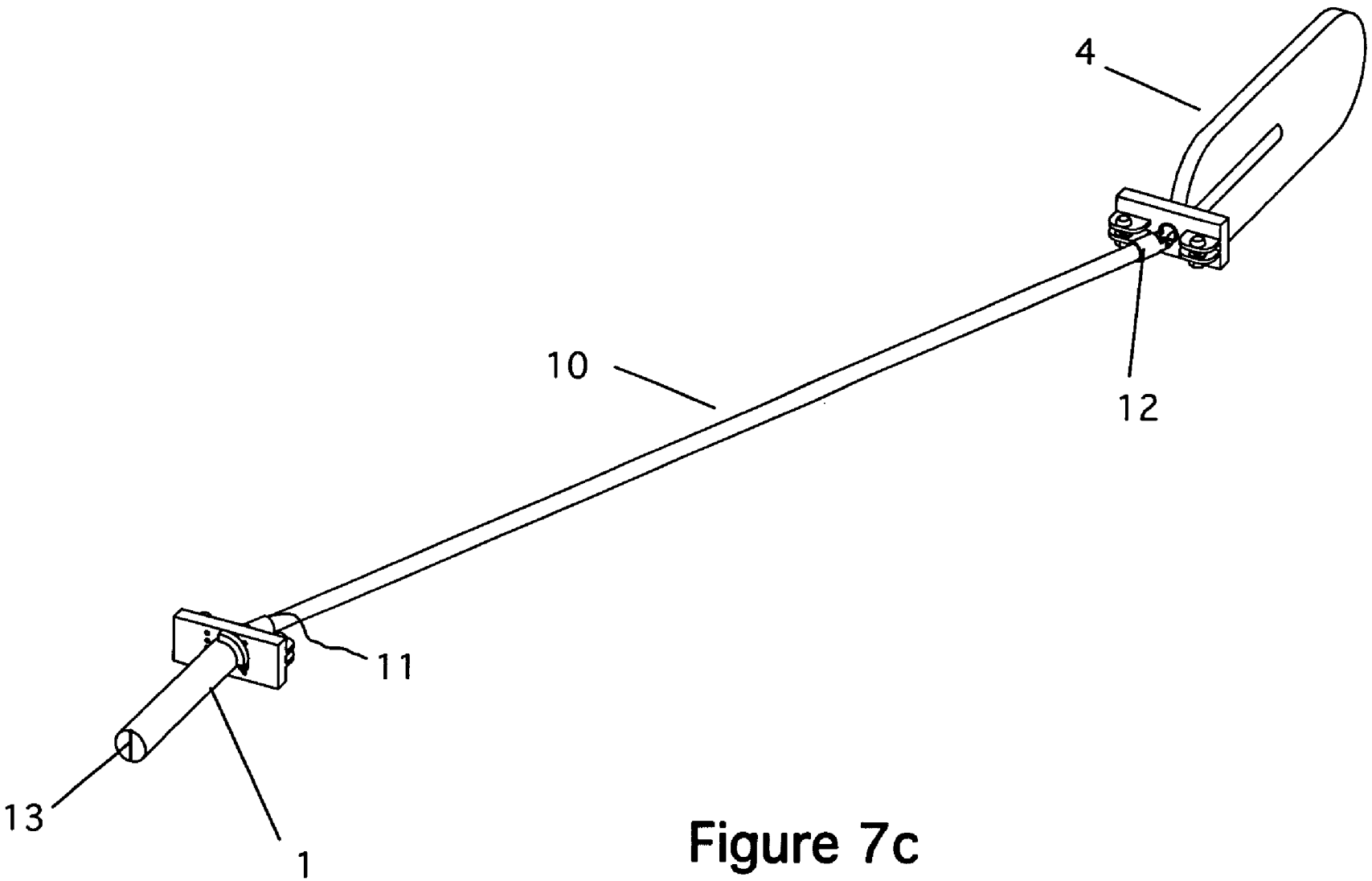
FIG. 7*c* is a perspective view of the feathering system with the oar shafts not shown and the blade in the fully unfeathered position.

FIG. 7*a* is a detail view of the feathering system showing the blade fully feathered. The feathering system uses a feathering rod 10 that is attached to the handle by a first universal joint 11 and to the blade by a second universal joint 12. FIG. 7*b* is a detail view of the feathering system showing the blade partially turned for a power stroke. Here, the handle 1 has been turned (see the register mark 13). As the handle is turned, the feathering rod 10 is turned as well. This, in turn, causes the blade 4 to turn as shown. FIG. 7*c* is a detail view of the feathering system showing the blade fully turned for a power stroke. As shown, the register mark 13 is now vertical as is the blade.

Figure 8:
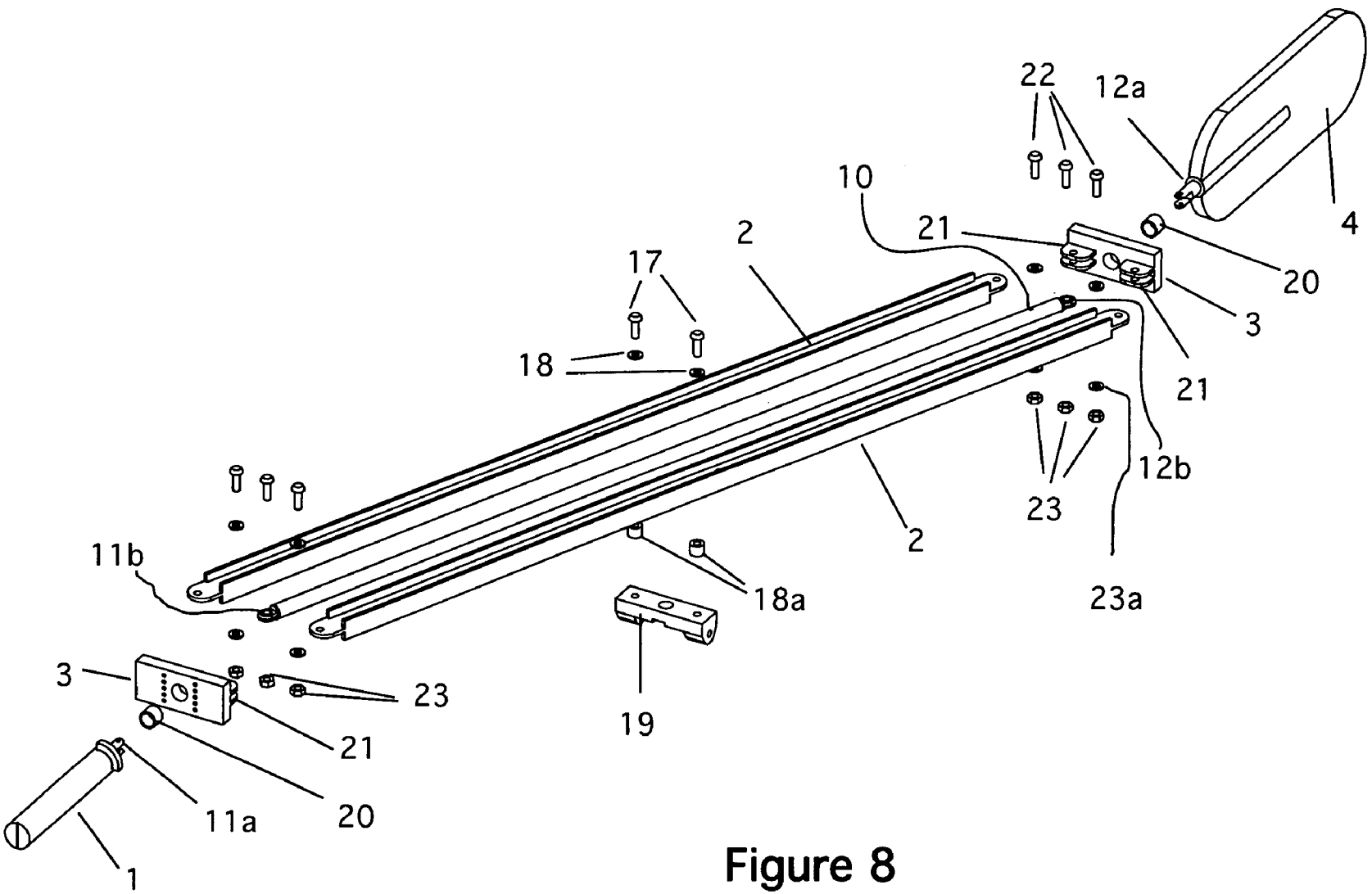
FIG. 8 is an exploded view of the entire oar system.

FIG. 8 is an exploded view of the entire oar system of the preferred embodiment. The handle 1 is attached to the feathering rod via universal joint 11*a* and 11*b* through the end connector 3 (note both end connectors are identical). It is supported by a bushing 20. The end connector has two brackets 21 that secure the ends of the oar shafts and support bushing 20. The oar shafts (as discussed below) have flat ends that are held to the brackets 21 by 22, loosely to permit free rotation of the shafts during each stroke. In between the two oar shafts 2 is the feathering rod 10. At each end of the feathering rod 10 is one half of a universal joint 11*a* and 12*a*. The other half of the universal joints 11*b* and 12*b* are attached to the end of the handle and the blade respectively. The other ends of the oar shafts are attached to the end connector 3 at the blade end of the oar. Finally, the blade 4 is attached to the feathering rod using the universal joint 12*a*, as shown. The pivot body 19 of the oarlock 15 is attached to the oar shafts, as discussed above, while the oar shafts are attached by the pins 17.

Figure 9:
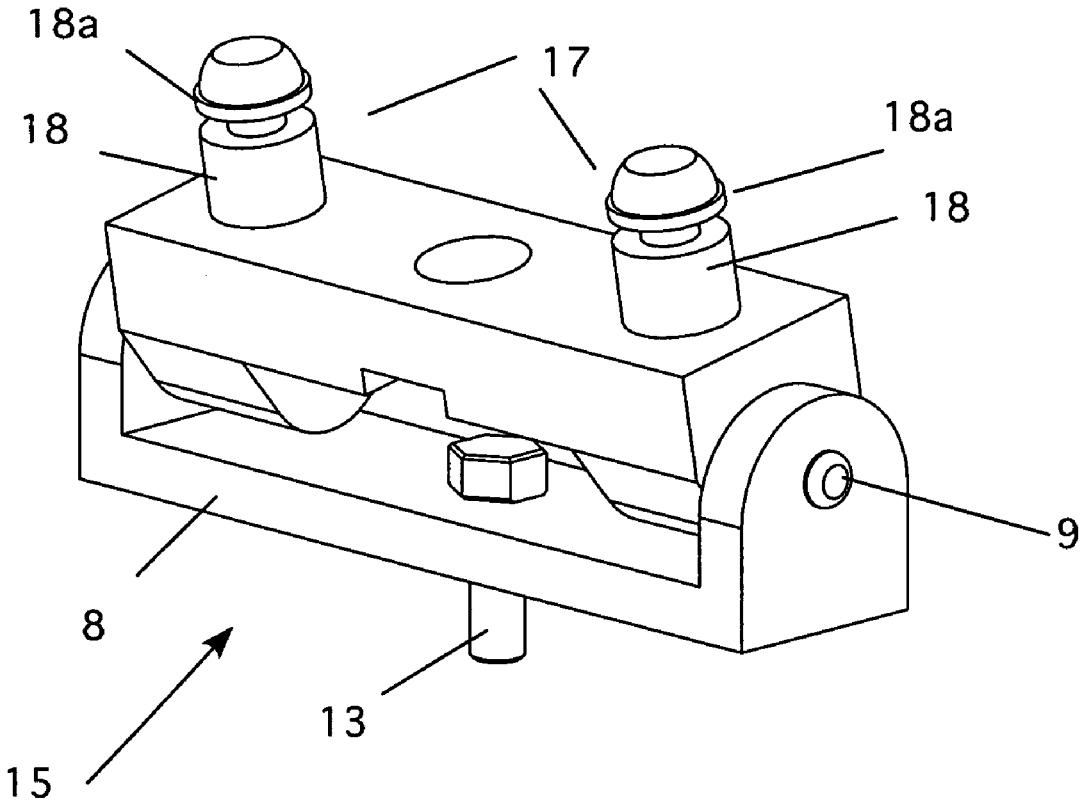
FIG. 9 is a perspective view of the preferred oarlock.

FIG. 9 is a perspective view of the preferred embodiment of the oarlock 15. This embodiment uses oar shafts formed of an H-beam construction (as discussed below). Because the oar shafts have a flattened center portion, the clamps 6 are replaced by pins 17. Spacers 18 are used to reduce friction between the pins and the oar shafts 2. Shoulder bushings 18*a* are used as additional spacers to accommodate the side flanges on the oar shafts. The pivot body 19 is shown in a neutral position. The pivot body has a generally rectangular upper portion and two side flanges. The pivot pins 9 are secured to these flanges. The bracket 8 has a flat base as shown. A bolt 13 attached the bracket 8 to a collar that attaches to an outrigger (not shown).

Figure 10:
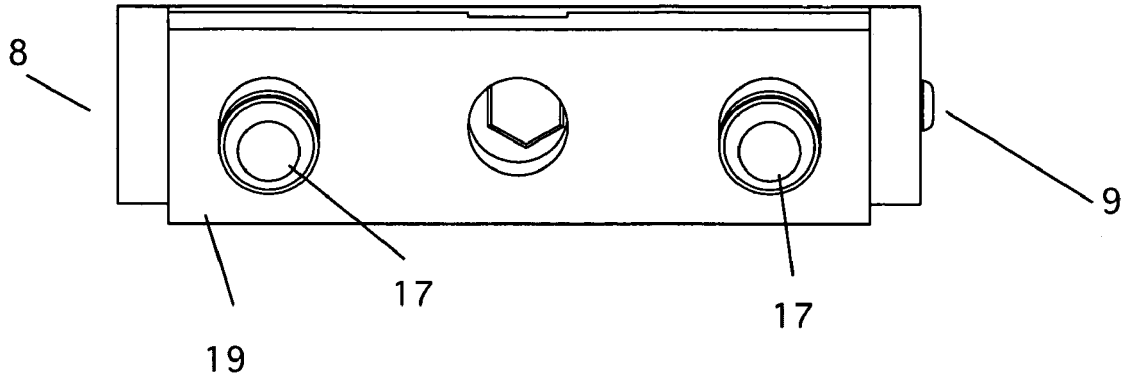
FIG. 10 is a top view of the preferred oarlock.
Figure 11:
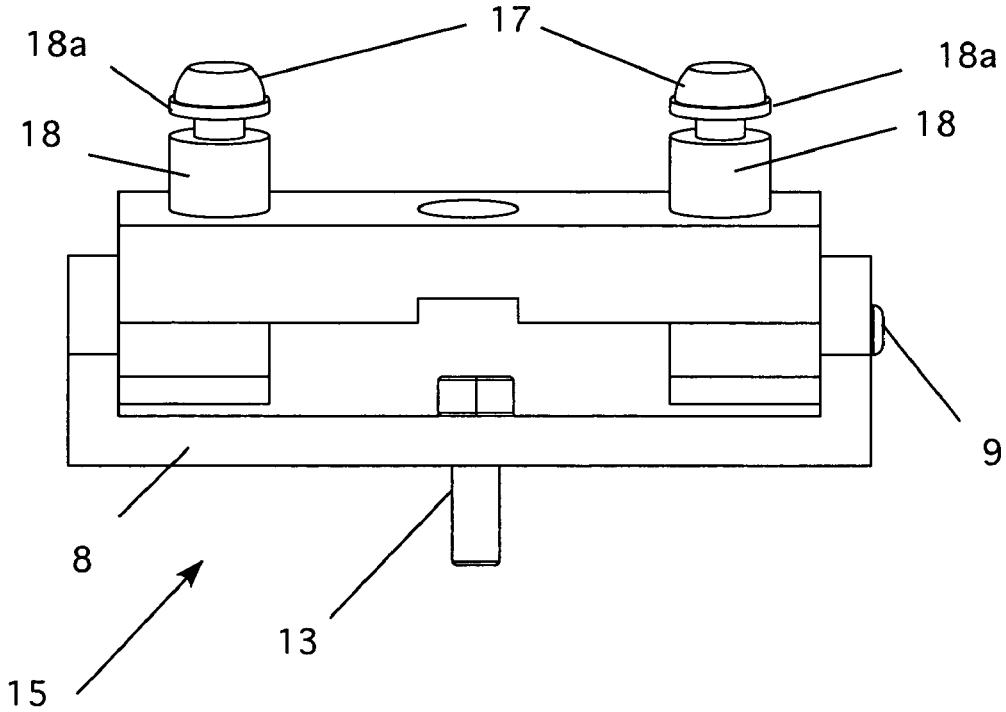
FIG. 11 is a front view of the preferred oarlock.
Figure 12:
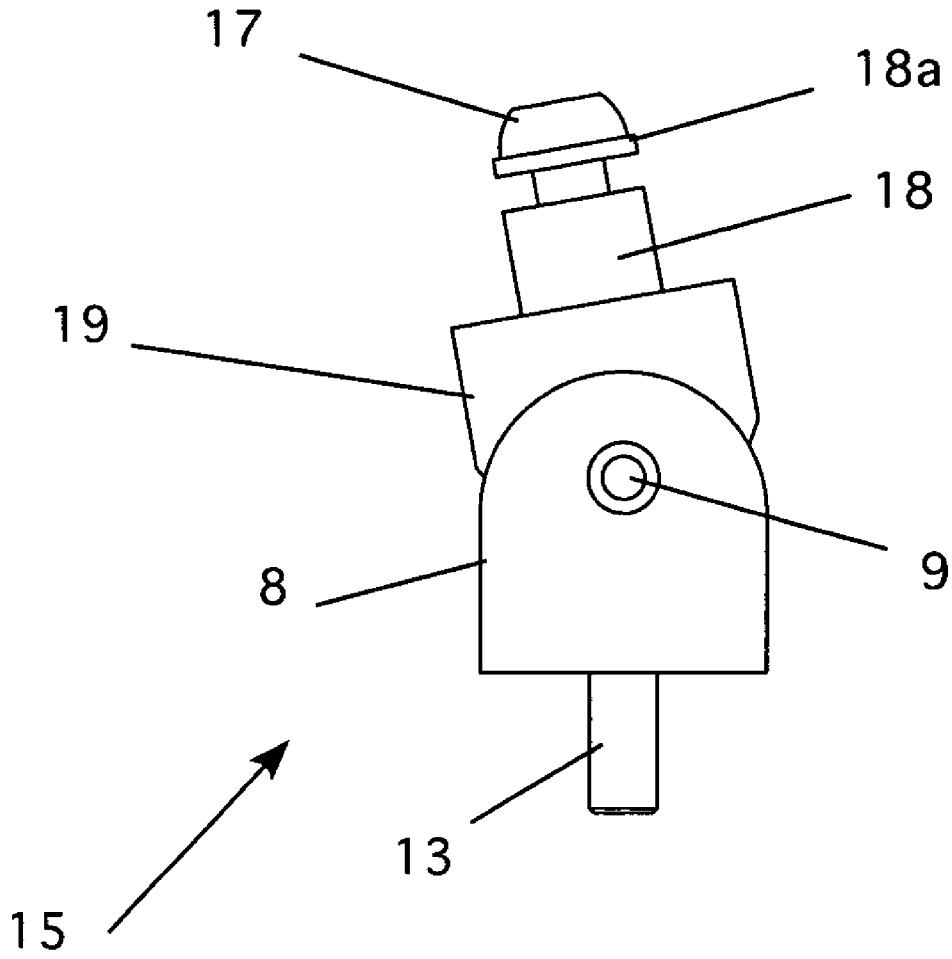
FIG. 12 is a side view of the preferred oarlock.

FIG. 10 is a top view of the oarlock. FIG. 11 is front view of the preferred the oarlock showing the feathering rod support 16. In the center of the pivot body 19 is a threaded hole 16*a* that holds a support 16 for the feathering rod 17 (discussed below). The feathering rod support is positioned between the oar shafts. FIG. 12 is an end view of the preferred oarlock showing the pivot body slightly tilted in the bracket.

Figure 13:
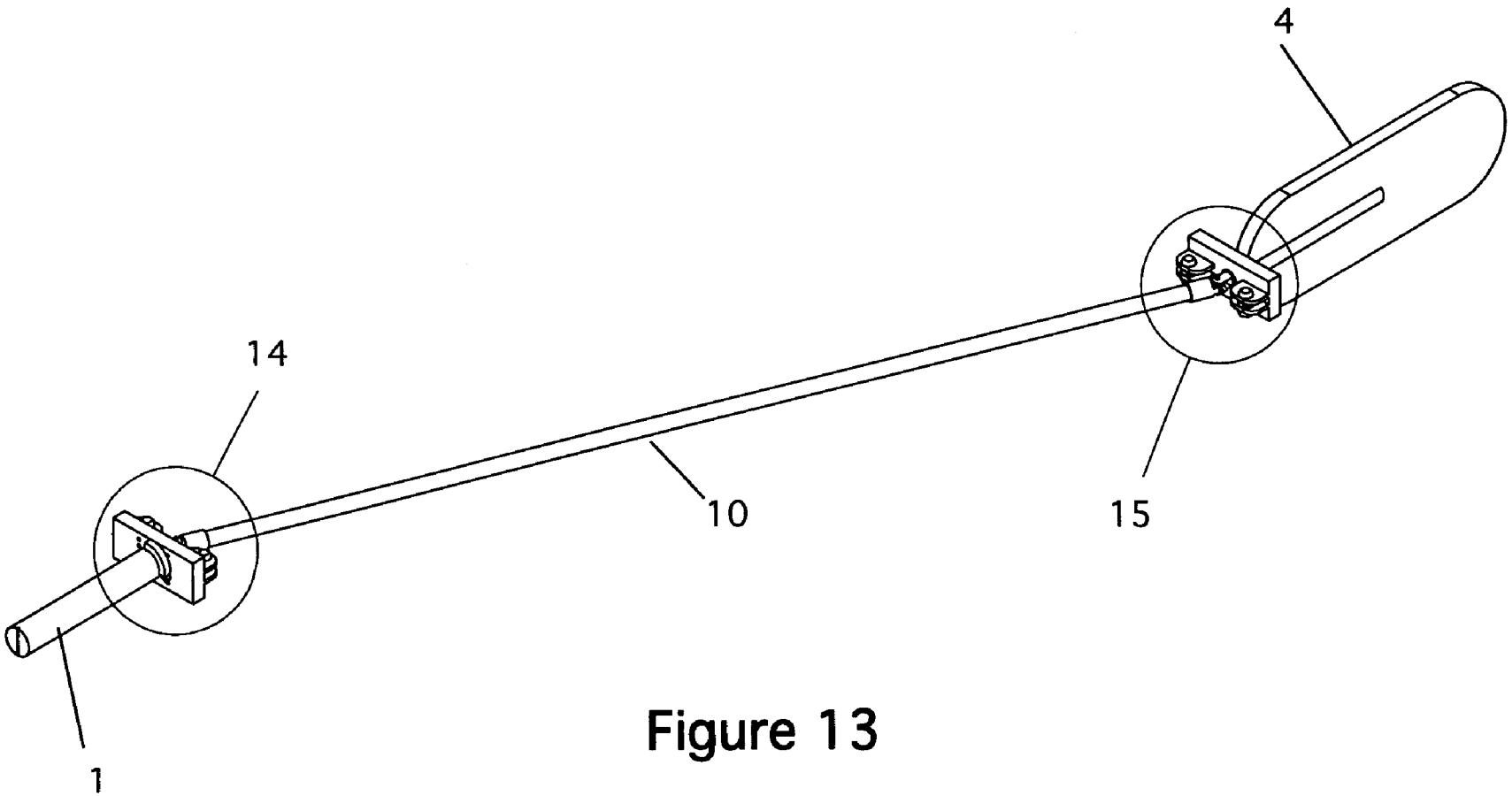
FIG. 13 is a perspective of the view of the feathering system showing the blade fully unfeathered.

FIG. 13 is a detail of the feathering rod connection the blade similar to FIG. 7*c*.

Figure 14:
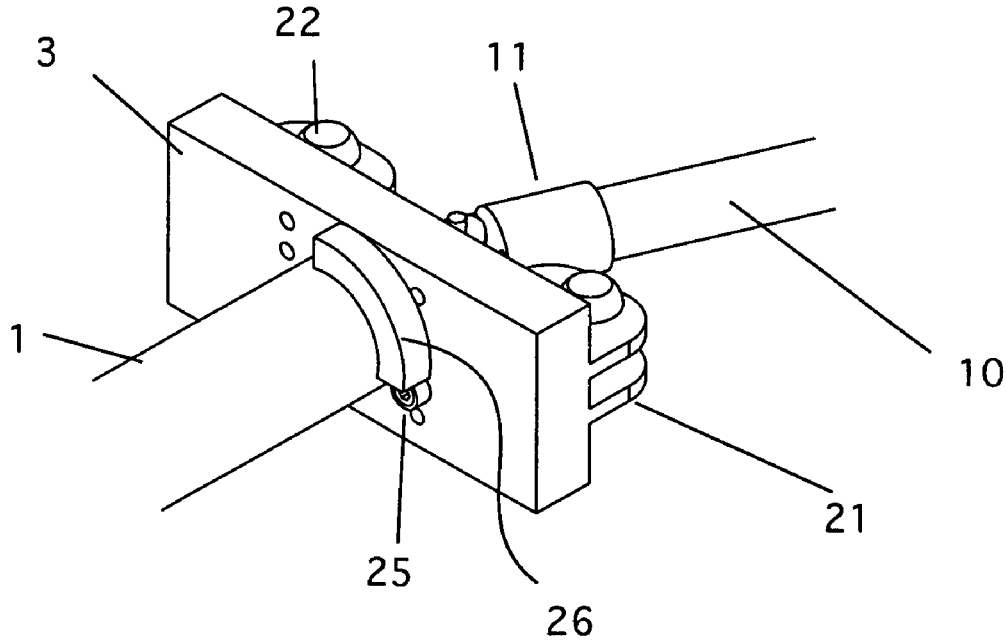
FIG. 14 is an enlarged detail of the feathering rod connection to the handle.

FIG. 14 is an enlarged view of the connector 3 on the handle end, showing details of the feathering system.

Figure 15:
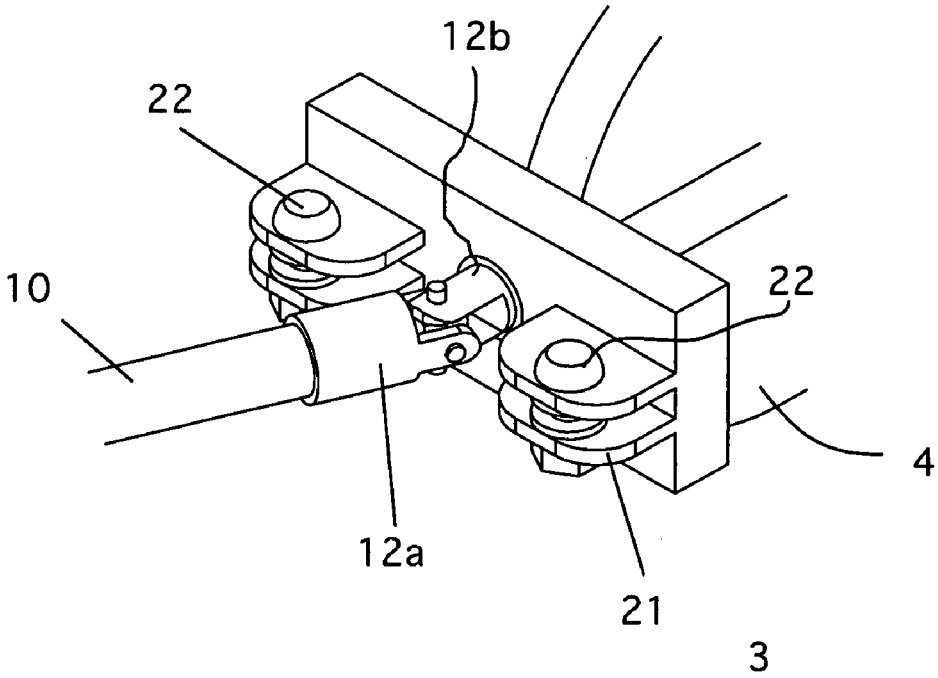
FIG. 15 is an enlarged detail of the feathering rod connection to the blade.

FIG. 15 is an enlarged view of the connector 3 on the blade end, showing details of the feathering system.

Figure 16A:
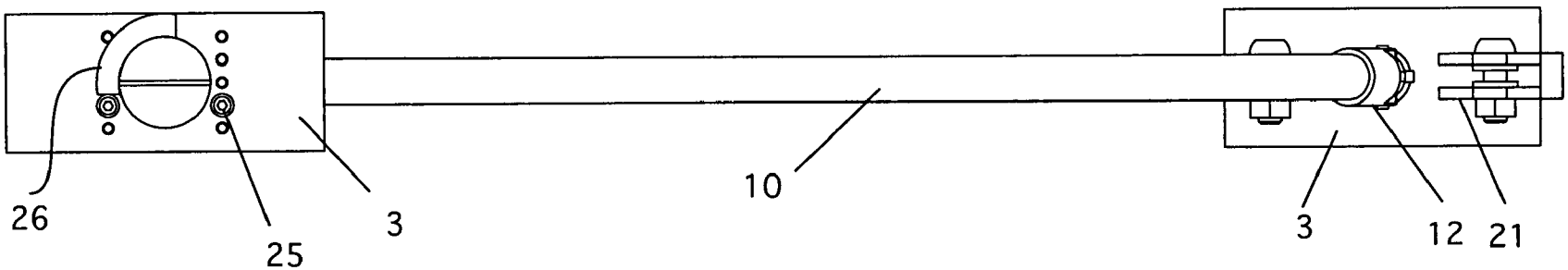
FIG. 16*a* is a front view of the end connectors showing the blade angle adjustment pins and the handle stops of a first embodiment in the fully feathered position.
Figure 16B:
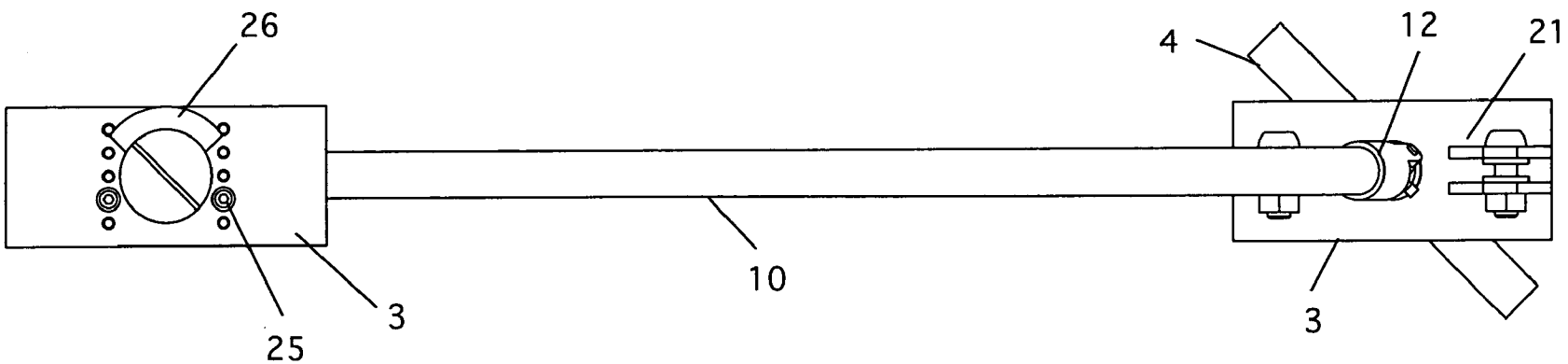
FIG. 16*b* is a front view of the end connectors showing the blade angle adjustment pins and the handle stops of a first embodiment in the partially feathered position.
Figure 16C:
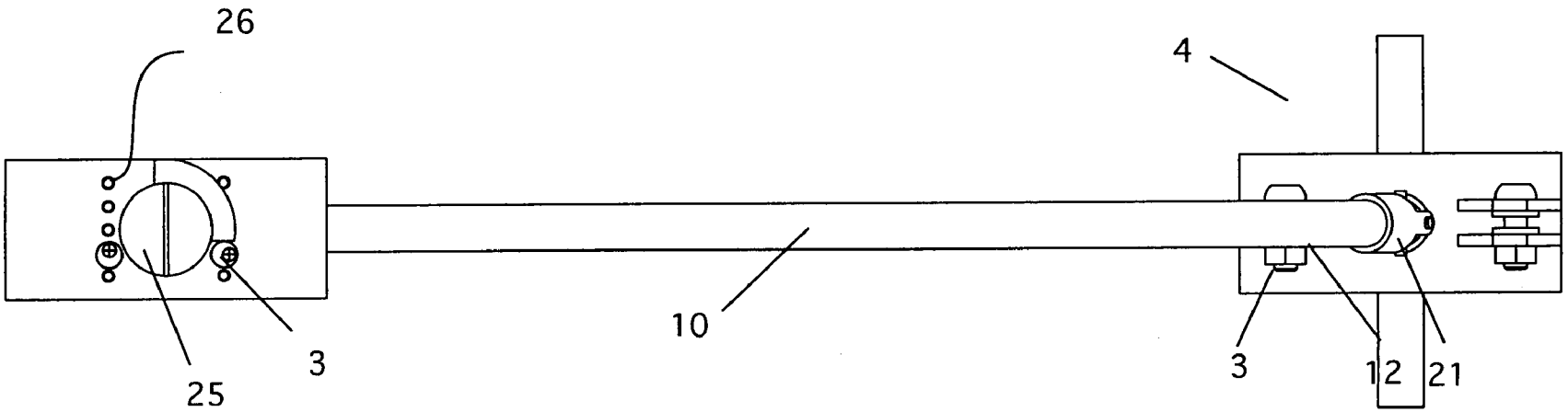
FIG. 16*c* is a front view of the end connectors showing the blade angle adjustment pins and the handle stops of a first embodiment in the fully unfeathered position.

FIGS. 16*a*–16*c* are detail views of the end connector showing the blade angle adjustment pins and stops on the handle and the relationships of the handle and blade. In FIG. 16*a* the system for limiting and adjusting the blade consists of a blade angle adjustment pin 25 that extends through the base of the handle universal joint 11*a* on the inside of the end connectors and two blade angle adjustment stops 26. These stops are semi-circular and are positioned adjacent to the blade angle adjustment pin. When the blade reaches the desired feathering angle on the return stroke, the blade angle adjustment pin 25 is stopped by the blade angle adjustment stops 26. Similarly, when the rower turns the oar handle 2 counterclockwise at the beginning of the power stroke, the blade angle adjustment pin 25 is stopped by the blade angle adjustment stops 26 when the desired attack angle has been reached Once the desired angles have been selected, the blade angle adjustment stops are locked down by tightening two locking nuts (not shown) that fix each of them to the inside of the end connectors. Additional adjustment is possible by adding eccentric cam heads to the adjustment pins 25 as shown in FIG. 16*c*.

FIGS. 16*b* and 16*c* show the movement of the handle and blade as well as the operation of the stop.

FIGS. 16*a*–*c* show one embodiment of handle stop and universal joint connection. While the multiple spacing holes provide versatility in adjusting the stop movement, a simpler design is preferred. FIGS. 21 and 22 show the preferred embodiments for the handle stop and universal joint for the feathering system. This embodiment is preferred because it is simpler to build and use than the embodiment of FIGS. 16*a*–16*c*.

Figure 21A:
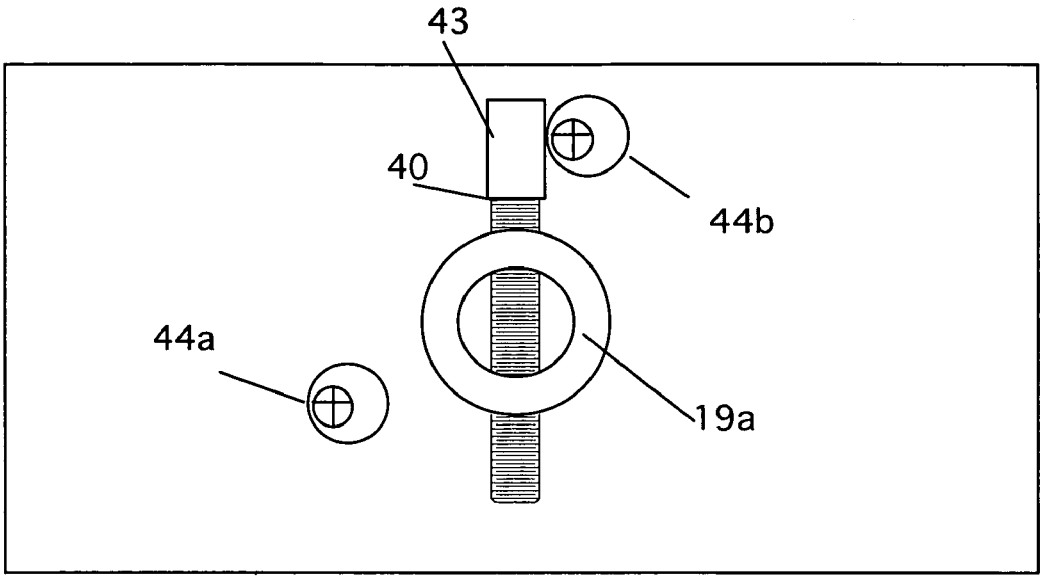
FIG. 21*a* is a front view of the preferred embodiment of handle stops for the feathering system, showing the adjustment stop in a first position and the bolt upright.
Figure 21B:
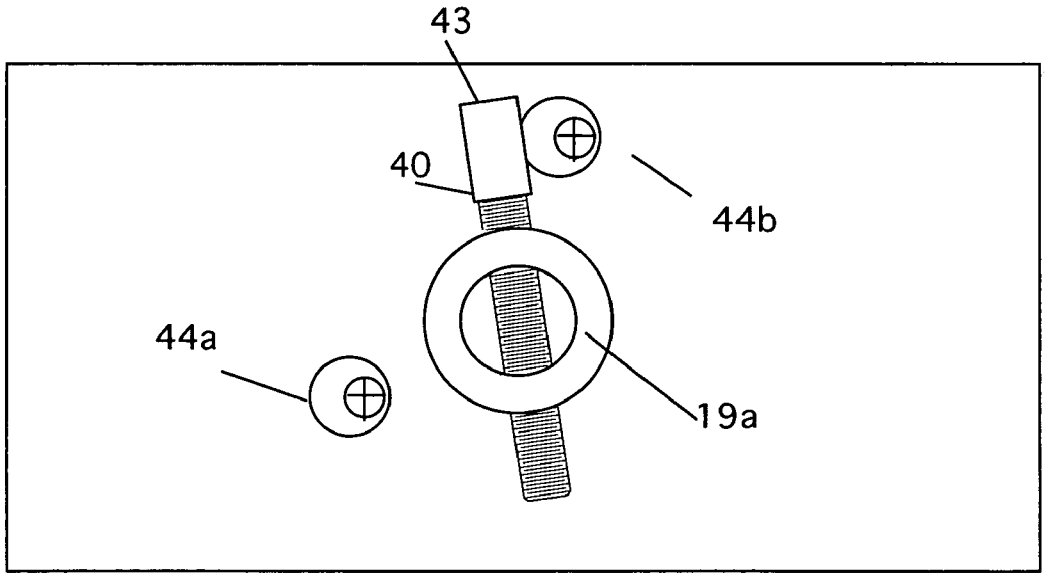
FIG. 21*b* is a front view of the preferred embodiment of handle stops for the feathering system, showing the adjustment stop in a second position and the bolt upright.
Figure 22:
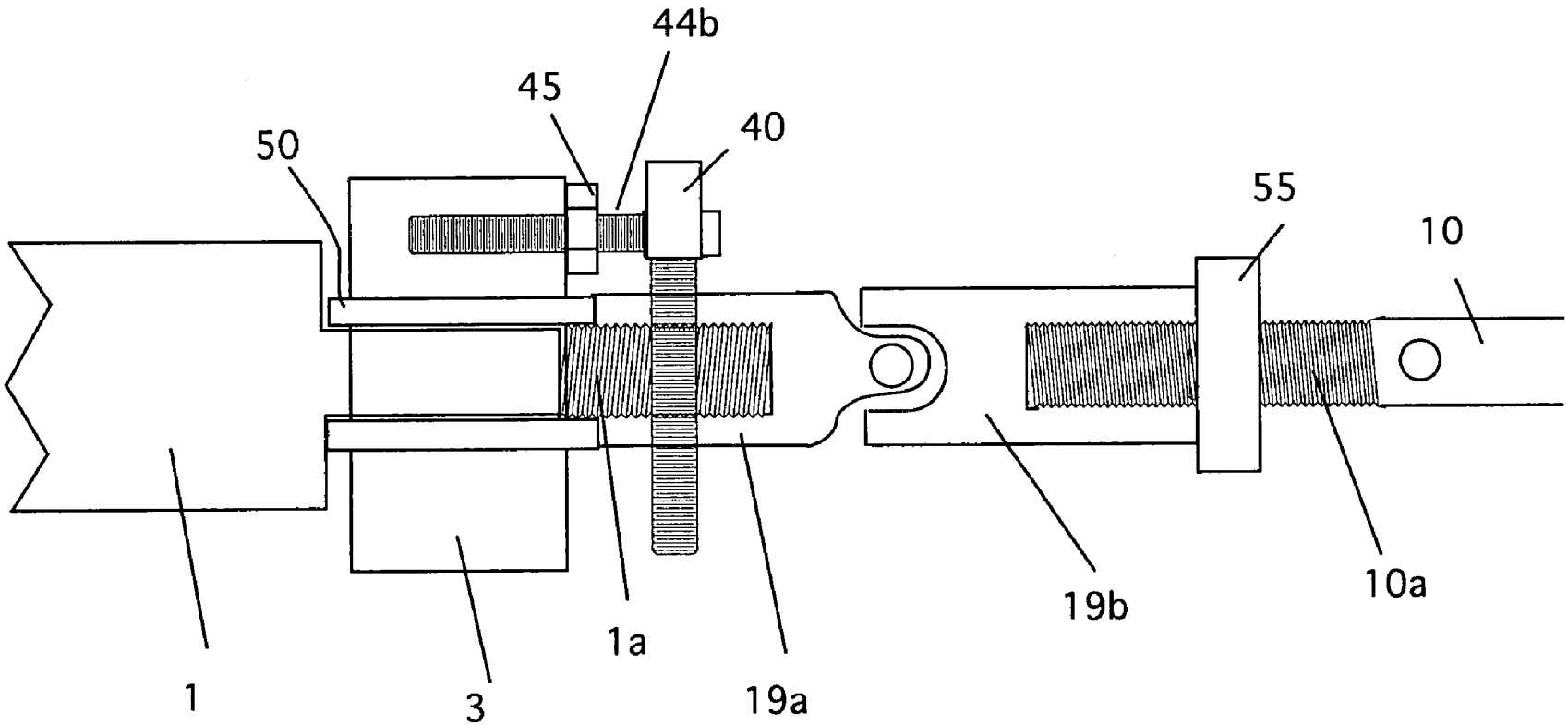
FIG. 22 is a cross-sectional view of the preferred embodiment of the feathering system universal joint connection to the handle.

FIG. 21*a* is a front view of the preferred embodiment of handle stops for the feathering system. In this embodiment, the multiple spacing holes 27 are removed and replaced with a pair of holes. Moreover, the arced member 25 is eliminated. A threaded bolt 40 passes through the handle end 42 of the universal joint 41. The top of the bolt 40 has an elongated flat surface 43, which is designed to make contact with the stop pins 44*a* and 44*b*. Pin 44*a* is a bolt that is threaded into the end block. It can be secured by a lock nut, if desired. The pin 44*b* is an eccentric bolt. It too is threaded into the end connector as shown and is secured by a locknut 45. The eccentric head of the bolt allows the user to make fine adjustments of the feathering system. As shown in FIG. 21*a*, the bolt 40 is upright and the bolt 44*a* is shown in a first position, which allows the bolt 40 to move to a position that contacts the side of bolt 44*a*. In FIG. 21*b*, the bolt 44*a* is turned 180 degrees. Here, the bolt 40 cannot be turned as far as in the position of FIG. 21*a*. This allows the user to make precise adjustments to the feathering system, as the bolt 44*a* can be set to any position between those shown in FIGS. 21*a* and 21*b*.

Figure 21C:
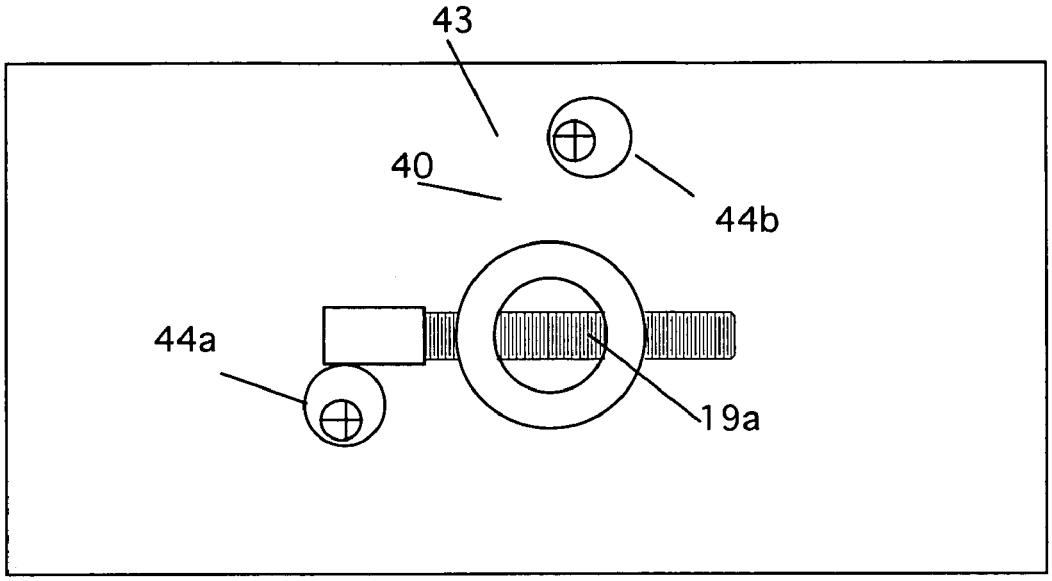
FIG. 21*c* is a front view of the preferred embodiment of handle stops for the feathering system, showing the bolt in a rotated position and the lower stop in a first position.
Figure 21D:
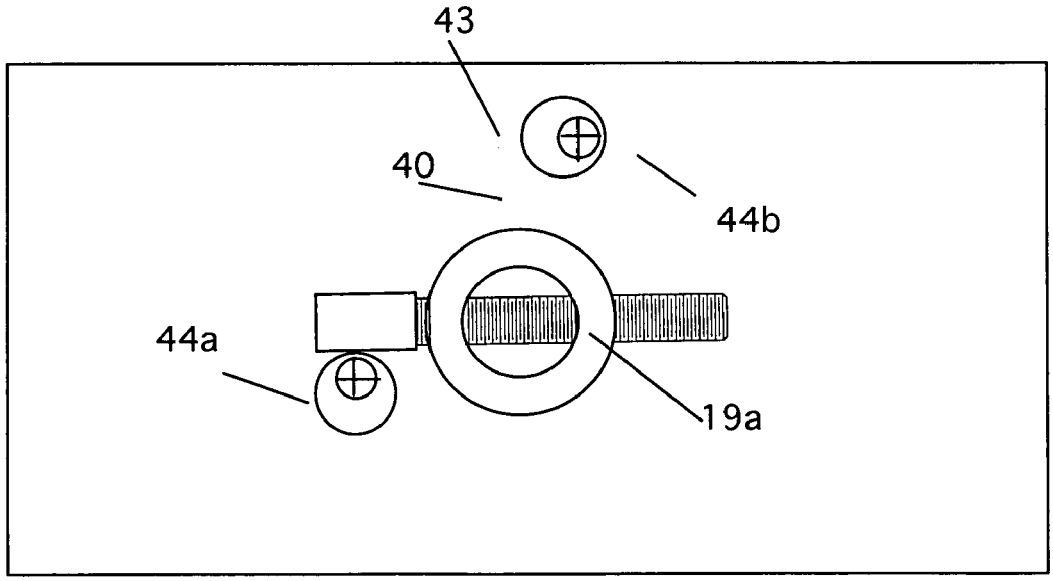
FIG. 21*d* is a front view of the preferred embodiment of handle stops for the feathering system, showing the bolt in a rotated position and the lower stop in a second position.

FIG. 21*c* is a front view of the preferred embodiment of handle stops for the feathering system, showing the bolt 40 in a rotated position and the lower stop 44*b* in a first position. FIG. 21*d* is a front view of the preferred embodiment of handle stops for the feathering system, showing the bolt 40 in a rotated position and the lower stop 44*b* in a second position. As before, the cam action of the bolt 44*b* allows fine adjustment of the position of the bolt 40 at its ending positions.

FIG. 22 is a cross-sectional view of the preferred embodiment of the feathering system universal joint connection to the handle. Here, the handle 1 has a threaded end portion 1*a* that passes through the end connector 3. A bushing 20 can be used to reduce the friction in the end connector is desired. The threaded portion 1*a* of the handle is then screwed into the handle end 11*a* of the universal joint 11. As mentioned above, the stop bolt 40 is threaded through both the handle end of the universal joint and the threaded end of the handle. The universal joint 19 has a pin that connects the handle end 11*a* to the feathering rod end 11*b*. The feathering rod 10 also has a threaded end 10*a* that screws into the universal joint as shown. A lock nut 55 is used to secure the feathering rod in the universal joint to ensure that the rod does not turn except when moved by the handle.

The feathering rod plays an important role in holding together the oar handle and blade. Finding the correct length of the feathering rod is necessary in order to achieve the optimal balance between friction and free play. The adjustment mechanism for altering the length of the feathering rod is the use of threads of opposite direction on either end. One end of the feathering rod has right-hand threads attaching it to the Universal Joint 11*b* and the other has left-hand threads attaching it to the other the Universal Joint 12*b*. Therefore turning the feathering rod one way will lengthen the rod and turning it in the other will shorten it. When the proper adjustment is achieved, lock nuts are used to insure that the rod does not turn relative to the universal joints.

Figure 17:
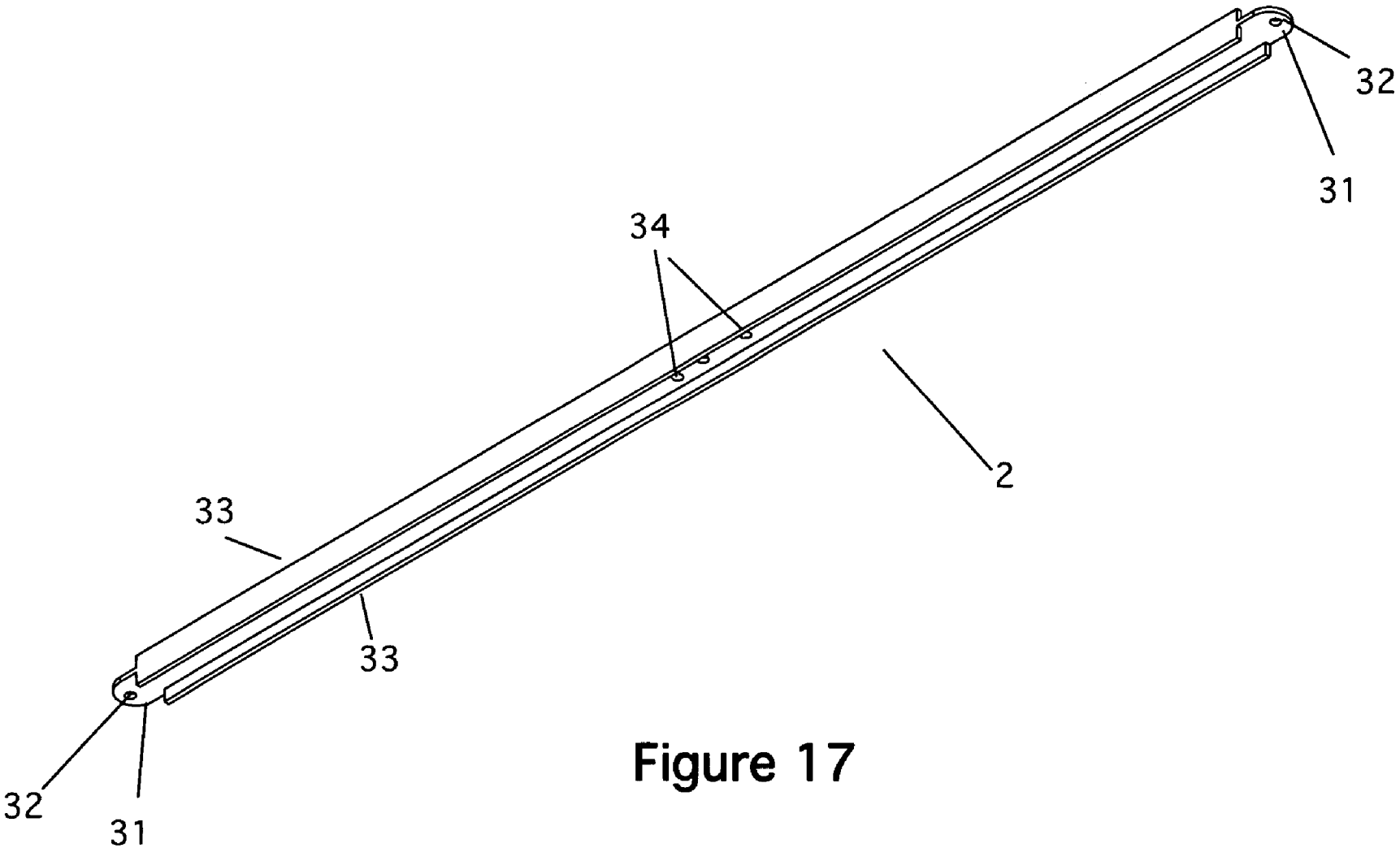
FIG. 17 is a perspective view of one of the oar system's H-beams.
Figure 18:
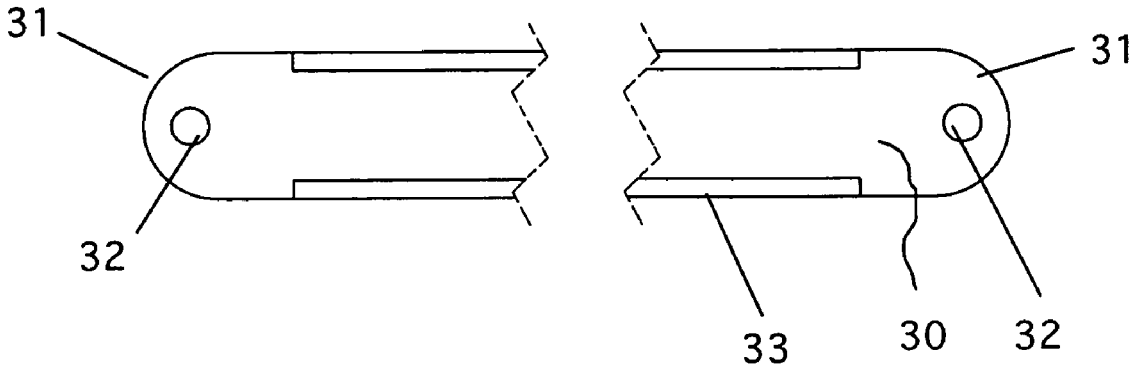
FIG. 18 is a top view of one of the oar system's H-beams.
Figure 19:
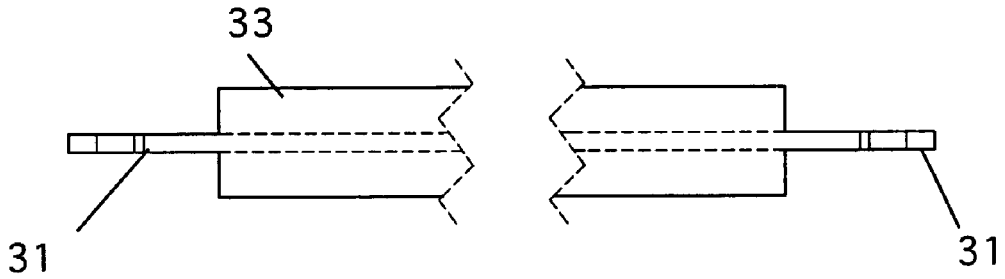
FIG. 19 is a side view of one of the oar system's H-beams.
Figure 20:
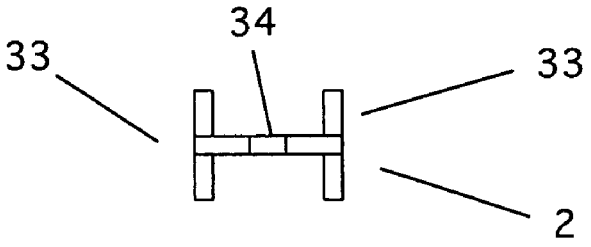
FIG. 20 is an end view of one of the oar system's H-beams.

As discussed above, the preferred embodiment uses an H-beam construction for the oar shafts. FIG. 17 is a perspective view of one of the oar system's H-beams. As mentioned above, in the preferred embodiment, the oar shafts are H-beams. FIG. 18 is a top view of one of the oar system's H-beams. FIG. 19 is a side view of one of the oar system's H-beams. FIG. 20 is an end view of one of the oar system's H-beams. The oar shaft has a center web 30 that has two curved ends 31 as shown. The curved ends have holes 32 to permit the oar shaft to be attached to the end connectors, as described above. Two flanges 33 are formed on the sides of the center web to complete the H-beam form. Note that the flanges do not extend to the curved ends. This is done to permit the curved ends to rotate in the brackets as the oar is operated. FIG. 17 shows the center of the oar shaft. Here, three holes 34 are shown. These holes are used to attach the oar shaft to the oarlock. The three holes allow for position adjustment of the oar shaft on the oarlock as is needed to adjust the leverage/stroke.

In the present invention, the oar handle and blade are easily removed by removing the blade angle adjustment pin from the universal joint and unscrewing the threaded handle and/or blade. By removing the pin(s), the handle and/or blade can be removed and replaced with ones of different sizes or shapes.

High efficiency oars must be both stiff and lightweight in order to perform. This is especially important in the present invention since two shafts are required for each oar in addition to other components that are not needed on standard "one-piece" oars. Carbon fiber or some other strong, lightweight composite material is recommended for the oar shafts, as they are both stiff and lightweight. Further, it is recommended that the shafts utilize an "H-Beam" (I-Beam lying sideways) to further increase the stiffness while keeping the mass to a minimum.

It should be noted that the shaft's material and shape represent the preferred embodiment. Shafts made of other material (wood, aluminum, plastic, etc.) and shapes, (round, square, rectangular, triangular, etc.) can also be used.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

The invention claimed is:

1. An oar comprising:

a) a handle;

b) an end connector, operably attached to said handle, said end connector having a first means for attaching a first oar shaft, and a second means for attaching a second oar shaft, installed thereon;

c) a first oar shaft having two ends, wherein one of said ends is rotatably attached to the first means for attaching a first oar shaft on said end connector;

d) a second oar shaft, having two ends, wherein one of said ends is rotatably attached to the second means for attaching a second oar shaft on said end connector;

e) a second end connector, also having a first means for attaching a first oar shaft, and further wherein the other end of said first oar shaft is pivotably attached to the first means for attaching a first oar shaft and the other end of said second oar shaft is pivotably attached to a second means for attaching a second oar shaft on said second end connector, such that said first and second or shafts are in a generally parallel configuration; and f) a blade, operably attached to said second end connector.

2. The oar of claim 1 wherein the first and second oar shafts are cylindrical.

3. The oar of claim 1 wherein the first and second oar shafts are members having an "H" shaped configuration.

4. The oar of claim 1 wherein the first means for attaching a first oar shaft comprises a bracket and a pivot pin, removably installed in said bracket.

5. The oar of claim 1 wherein the second means for attaching a second oar shaft comprises a bracket and a pivot pin, removably installed in said bracket.

6. The oar of claim 1 further comprising an oarlock, positioned intermediately between said end connector and said second end connector.

7. The oar of claim 6 wherein said oarlock comprises:

a) a lower bracket;

b) a head piece, pivotably attached to said lower bracket; and c) a means for pivotably retaining said first and second oar shafts on said headpiece.

8. The oar of claim 1 further comprising a means for feathering said blade during an oar stroke.

9. The oar of claim 8 wherein the means for feathering said blade during an oar stroke comprise:

a) a feathering rod, having two ends;

b) a first universal joint, attached to said handle and to one end of said feathering rod; and c) a second universal joint, attached to the other end of said feathering rod and to said blade;

d) whereby, when said handle is rotated about a longitudinal axis of said oar, said feathering rod is rotated, thereby causing said blade to rotate about a longitudinal axis of said oar.

10. The oar of claim 9 wherein said first universal joint passes through said end connector.

11. The oar of claim 10 further comprising a means for stopping the rotation of said handle, operably installed in said end connector.

12. An oar comprising:

a) a handle;

b) an end connector, operably attached to said handle, said end connector having two brackets installed thereon, said two brackets extending outward away from said handle;

c) a first oar shaft, having two ends and a center, wherein one of said ends is pivotably attached to one of said two brackets on said end connector;

d) a second oar shaft, having two ends and a center, wherein one of said ends is pivotably attached to the second of said two brackets on said end connector;

e) a second end connector, also having two brackets, and further wherein the other end of said first oar shaft is pivotably attached to one of said two brackets and the other end of said second oar shaft is pivotably attached to the second of said two brackets on said second end connector, such that said first and second oar shafts are in a generally parallel configuration; and f) a blade, operably attached to said second end connector.

13. The oar of claim 12 further comprising an oarlock, positioned intermediately between said end connector and said second end connector.

14. The oar of claim 13 wherein said oarlock comprises:

a) a lower bracket;

b) a head piece, pivotably attached to said lower bracket; and c) a means for pivotably retaining said first and second oar shafts on said headpiece.

15. The oar of claim 12 further comprising a means for feathering said blade during an oar stroke.

16. The oar of claim 15 wherein the means for feathering said blade during an oar stroke comprise:

a) a feathering rod, having two ends;

b) a first universal joint, attached to said handle and to one end of said feathering rod; and c) a second universal joint, attached to the other end of said feathering rod and to said blade;

d) whereby, when said handle is rotated about a longitudinal axis of said oar, said feathering rod is rotated, thereby causing said blade to rotate about a longitudinal axis of said oar.

17. The oar of claim 16 wherein said first universal joint passes through said end connector.

18. The oar of claim 17 further comprising a means for stopping the rotation of said handle, operably installed in said end connector.

* * * * *